United States Patent [19]

Suzuki et al.

[11] 4,401,383

[45] Aug. 30, 1983

[54] TRANSFER DEVICE FOR USE IN RETENTION TYPE ELECTROPHOTOGRAPHIC COPYING MACHINE

[75] Inventors: Yoshiro Suzuki; Tadahiro Yasuda; Masaji Nishikawa; Eiichi Sato; Tadashi Aoki, all of Hachioji, Japan

[73] Assignee: Olympus Optical Company Limited, Tokyo, Japan

[21] Appl. No.: 311,904

[22] Filed: Oct. 15, 1981

[30] Foreign Application Priority Data

Oct. 16, 1980 [JP] Japan ..... 55-143695

[51] Int. Cl.[3] ..... G03G 15/00

[52] U.S. Cl. ..... 355/3 TR; 355/14 TR

[58] Field of Search ..... 355/3 TR, 3 R, 3 CH, 355/14 CH, 3 SH, 3 TE, 14 TR

[56] References Cited

U.S. PATENT DOCUMENTS 4,055,380 10/1977 Borostyan ..... 355/3 TR
4,171,157 10/1979 Suzuki ..... 355/3 TR
4,184,870 1/1980 Suzuki ..... 355/3 TR
4,220,699 9/1980 Ishida et al. ..... 355/3 TR

*Primary Examiner*—R. L. Moses
*Attorney, Agent, or Firm*—Fleit, Jacobson & Cohn

[57] ABSTRACT

In a transfer roller for use in a retention type copying machine, a semiconductive transfer roller is connected through a current limiting resistor having a high resistance value of 100 MΩ to 1000 MΩ to a transferring bias voltage source. A pair of auxiliary transfer rollers made of conductive material are arranged on respective sides of the transfer roller. The auxiliary transfer rollers are connected to the transferring bias voltage source through a potentiometer. To the transfer roller is applied a first transferring bias voltage of 600 to 900 volts and to the auxiliary transfer rollers is applied a second transferring bias voltage of 400 to 650 volts. When a resistance of a record paper is decreased due to high humidity, the first transferring bias voltage is automatically decreased and the second transferring bias voltage becomes predominant.

9 Claims, 6 Drawing Figures

TRANSFER DEVICE FOR USE IN RETENTION TYPE ELECTROPHOTOGRAPHIC COPYING MACHINE

BACKGROUND OF THE INVENTION

The present invention relates to a transfer device for use in a retention type electrophotographic copying machine in which an electrostatic charge image once formed on a charge retentive member is repeatedly subjected to developing and transferring steps in succession to form a plurality of copies.

The applicant has developed such a retention type copying machine. FIG. 1 is a schematic diagram showing an embodiment of the copying machine of retention type developed by the Applicant and described in, for example, U.S. Pat. No. 4,215,931 issued on Aug. 5, 1980.

In FIG. 1 a sheet-like original 1 to be copied is placed on an inclined original table 2 and moved into an original feeder 3 in a direction shown by an arrow a, and feeding rollers 4 and 5 feed the original toward an original tray 6 while causing the original to pass through a transparent glass plate 7A above an illuminating lamp 7B, a reflection mirror 7C and an optical system 8. The optical system projects an image of the illuminated original 1 onto a rotary photosensitive drum 9. The photosensitive drum has a photoconductive layer 9A which, for instance, consists of selenium (Se) applied on a conductive substrate 9B. The photosensitive drum rotates in a direction shown by an arrow b. After removing charge by a charge removing lamp 10, the photoconductive layer is uniformly charged by a corona discharge device 11, so that upon projection of the aforesaid image of the original, an electrostatic latent image is formed on the photoconductive layer. This latent image is developed by a development device 12 which makes use of dry two-component developing agent, and then the developed image is forwarded to a toner-transfer station 13 as the photosensitive drum rotates.

On the other hand, a recording paper cassette 14 carries plural sheets of recording paper 15, and a rotary pickup roller 16 journaled to a swingable arm picks up the recording paper one sheet at a time, so as to feed the record paper to the toner-transfer station 13 at predetermined timing under the control of register rollers 17A and guide members 17B constituting a paper feed path 17. The toner-transfer station has a biased transfer roller 19. The recording paper 15 passes between the photosensitive drum 9 and the transfer roller 19 so as to overlay the toner image onto the recording paper to transfer the toner image thereon. During this process, the recording paper moves together with the toner image; i.e., in tight contact with the surface of the photosensitive drum, until separating pawls 21 separate the recording paper from the drum in cooperation with an air flow to be described hereinafter. A guide 17C directs the recording paper to feeding rollers 23 which feed the recording paper to a thermal fixing device 24 having a heater for fixing the toner image. Discharge rollers 25 discharge the recording paper with the fixed toner image out of the copying machine onto a copy tray 26. Since the toner image on the photosensitive drum is not completely transferred to the recording paper and partially remains on the drum, a rotary cleaner brush 27 brushes off residual toner from the photosensitive drum after the toner image passes through the toner-transfer station. A fan 28 generates an air flow to suck the brushed-off toner, and a filter 29 collects the toner particles from the air flow. A housing 30 encloses the cleaner brush and fan to produce an effective suction for sucking the toner and to prevent the toner particles from being scattered in the apparatus. The exhaust from the fan is guided by a duct 31 having an outlet facing the toner-transfer station 13, so that the exhaust air flow from the outlet of the duct coacts with the separating pawls 21 in separating the recording paper 15 from the photosensitive drum 9 in a reliable fashion.

A support pin 32 swingably carries one end of an arm 33, and the opposite end of the arm rotatably holds the rotary cleaner brush 27. The cleaner brush is kept away from the photosensitive drum when the electrostatic latent image once formed on the photosensitive drum is repeatedly subjected to development and transferring for forming a plurality of copies of one original in the retentive manner. A trimming lamp 34 is provided to face the photosensitive drum in the proximity thereof at a position between the image projecting optical system 8 and the developing device 12, so as to remove the electric charge from blind areas or those areas of the photosensitive drum which do not intend to transfer any image to the recording paper. Switches 35 and 36 detect the positions of each original in the electrophotographic apparatus, so as to sequentially control the aforementioned constitutional parts of the apparatus. Further, at the copy discharging outlet of the copying machine is arranged a copy detection switch. When copying a thick manuscript such as a book, a cover 37 of the document feed device 3 is turned about a shaft 38 in a direction shown by an arrow c so as to form a planar document feed path for a transparent book carrier on which the book to be duplicated is placed.

The transfer roller 19 comprises a conductive shaft 19A and a semiconductive rubber roller 19B arranged around the shaft and the roller is connected to a transferring bias voltage source 20.

The transfer device 18 comprising the above mentioned biased transfer roller 19 is generally used in an ordinary copying machine of single copy type in which a single copy is formed from a single electrostatic charge image. In such a single copy type copying machine, the bias voltage higher than 1000 volts, preferably 2000 volts is applied to the transfer roller, because the higher the bias voltage is, the higher the transfer efficiency becomes. However, in the copying machine of retention type, when such a high bias voltage is applied to the transfer roller, the following drawbacks might occur.

When the high transfer bias is used and a greater amount of charge is applied on a rear surface of an image receiving paper, a discharge phenomenon might be produced when the paper is peeled off the photosensitive drum. When the discharging phenomenon occurs, the toner image transferred onto the record paper is damaged and the image quality of the duplicated copy deteriorates. This drawback equally occurs in the copying machine of the retention type as well as in the copying machine of the single copy type.

In the copying machine of the single copy type, the above undesired phenomenon can be reduced by decreasing the transfer bias voltage to some extent. However, in the retention type copying machine, even if the bias voltage is made lower, there is still produced a small amount of discharge between the drum and the paper upon peeling of the paper off the drum. These small discharging phenomena generate noise charge in the latent image. The noise charge is developed during a next developing step and the developed noise images are transferred onto a next record paper. In this manner, the copies other than the first one might include undesired dots in their backgrounds.

Secondly, when the record paper is damped under a high humidity condition and becomes less resistive, electrostatic charge injected from the transfer roller 19B travels easily in a direction of thickness of the paper and deposited on the photosensitive drum. It is apparent that the deposited charge forms undesired dots in the backgrounds of all copies after the first.

In order to avoid the above drawbacks, in the retention type copying machine, the transfer bias voltage has to be substantially lowered as compared with the single copy type machine. However, even if the bias potential is limited to a low value, when the record paper is dampened under a higher humidity condition, the efficiency of transferring the toner images onto the record papers might be severely decreased and good quality copies cannot be obtained. Causes of such an undesired phenomenon may be considered as follows. When the record paper is dampened, its resistance is decreased to a great extent and thus, a lot of charge is easily transferred from the transfer roller to the toners on the photosensitive drum through the paper, so that a sufficiently high transferring electric field could not be generated. Further, the charge might be moved in the record paper along its surface and might be conducted away into ground by means of one or more electrically conductive members which are arranged along a paper feed path and made contact with the paper, so that a sufficiently high bias voltage could no longer be applied between the drum surface and the rear surface of the paper.

In order to alleviate such a drawback, it has been known from U.S. Pat. No. 3,877,416 to connect a resistor 41 of high resistance value in series with the transfer bias voltage source 20 as illustrated in FIG. 2 and a higher transfer bias voltage is applied to the transfer roller 19 by means of the resistor 41. By means of such a measure, when the resistance of the dampened paper 15 is lowered, a voltage drop is generated across the resistor 41 due to a current flowing through the roller 19, and this voltage drop can prevent electrostatic charge of opposite polarity to that of the toners from being transferred to the toners on the charge image through the record paper 15. This solution is quite effective for the single copy tupe machine, but could hardly be applied to the retention type machine, because in the latter, the transfer bias voltage must be decreased to substantial extent as explained above and thus, if the resistor of extremely high value is connected, a bias voltage might become too small to effect the transferring operation normally occurring under conditions of high humidity.

In Japanese Patent Application Laid-open Publication No. 39,053/76 there has been proposed another solution, in which a paper feed member such as feed rollers 42 is arranged in the vicinity of the transfer roller 19 as illustrated in FIG. 3. One of the feed rollers 42 is connected to a voltage source 43 and an auxiliary bias voltage having a polarity and a magnitude the same as that of the transferring bias voltage applied from the voltage source 20 is applied to the feed roller 42.

By means of such measure, a potential on a point of the paper 15 at the feed rollers 42 is kept the same as that on a point of the paper at the transfer roller 19 and thus, when the resistance of the dampened paper is decreased, charge does not flow along the record paper althrough conductive members 44 arranged along the paper feed path are connected to ground. Therefore, the transferring bias voltage is kept high even if the dampened paper exhibits extremely low resistance. This solution is effective only for the single copy type machine, cannot be used in the retention type copying machine, because in the latter machine, a great amount of charge might be injected into the photosensitive drum 9 by means of the damped paper 15 from both of the sources 20 and 43 as shown by arrows in FIG. 3. Therefore, during the repetition of developing and transferring steps, the latent image might be damaged and undesired charge might be deposited on the background of the image and, so-called, fog might occur.

In the above mentioned known solutions, injection of charge onto the photosensitive member from the transfer roller is not taken into account, because in the single copy type machine, the deterioration of the charge image after development does not cause any trouble. On the other hand in the copying machine of the retention type, the deterioration of the latent image should be limited as far as possible and thus, the injection of charge onto the photosensitive drum can never be allowed. Therefore, the known solutions can never be applied to the retention type copying machine.

SUMMARY OF THE INVENTION

The present invention has for its object to provide a novel and useful transfer device for use in a copying machine of retention type, which device can overcome the various drawbacks of the known transfer devices and can always effect a stable transferring operation under low and high humidity conditions so that a number of copies having excellent image quality can be formed from the same and single latent image once formed on a charge retentive member.

According to the invention, a transfer device for use in a retention type electrophotographic copying machine in which a plurality of copies are formed from the same and single electrostatic charge image once formed on a charge retentive member by subjecting, repeatedly, the charge image to developing and transferring steps in succession, comprises a transfer member having a conductive shaft and a roller arranged around the shaft and made of semiconductive and elastic material, the roller being arranged at least in the vicinity of said charge retentive member;

a resistor connected in series with the conductive shaft;

a first transfer bias voltage source connected to the resistor so as to apply a first transfer bias voltage to the roller through the resistor;

an auxiliary transfer member arranged in the neighbourhood of the transfer means and contacting a record paper; and a second transfer bias voltage source connected to the auxiliary transfer member so as to apply a second transfer bias voltage to the auxiliary transfer member; whereby the first and second transfer bias voltages are set to such values that when the record paper is in a higher resistance condition, the first transfer bias voltage becomes operative to produce a transferring electric field, and when the record paper is in a lower resistance condition, the second transfer bias voltage becomes effective to generate the transferring electric field, so that an injection of charge into a background area of the charge image on the charge retentive member is prevented.

According to the invention, the first transfer bias voltage applied to the transfer roller and the second transfer bias voltage applied to the auxiliary transfer member are automatically changed in accordance with the resistance value of the record paper and the effective transferring electric field can be always formed. That is to say, in case of dry record papers of higher resistance, the transferring operation can be effected mainly by the transferring roller to which the first bias voltage is applied, but in the case of dampened record papers of lower resistance, the first bias voltage applied to the transferring roller is substantially lowered in an automatic manner due to the voltage drop across the resistor so as to prevent the injection of charge from the transferring roller. In this way, the necessary transferring electric field is generated by the second bias voltage applied to the auxiliary transferring member.

In a preferred embodiment of the transfer device according to the invention, the first bias voltage is set to a value within a range from 600 to 900 volts and the second bias voltage is selected to a value within a range from 400 to 650 volts.

DESCRIPTION OF THE PREFERRED EMBODIMENTS

Figure 1:
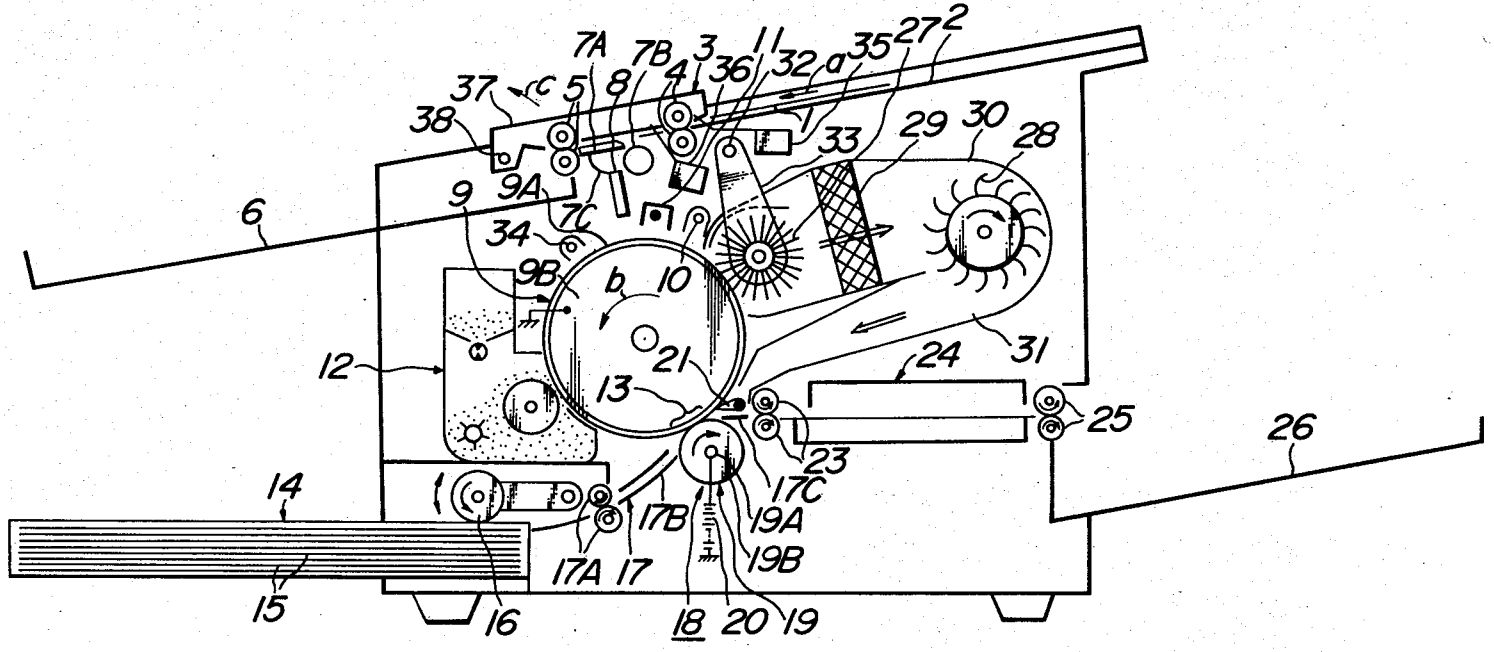
FIG. 1 PRIOR ART
FIG. 1 is a schematic view showing a known retention type copying machine to which the present invention can be advantageously applied.
Figure 2:
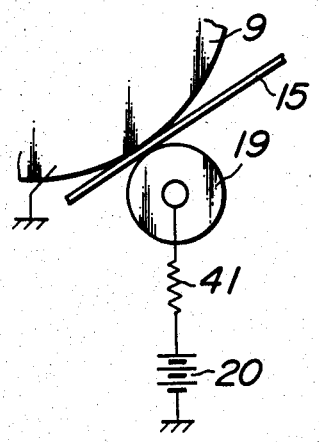
FIG. 2 PRIOR ART
FIGS. 2 and 3 are schematic views illustrating known biased transfer devices.
Figure 3:
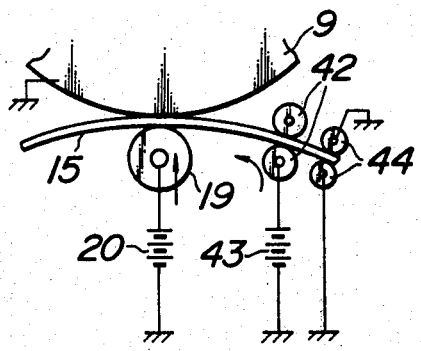
FIG. 3 PRIOR ART
Figure 4:
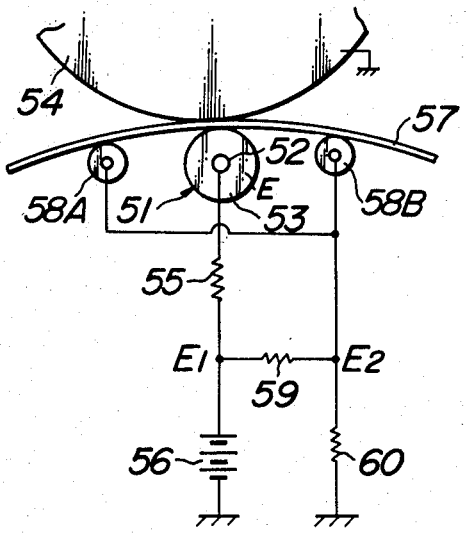
FIG. 4 is a schematic view depicting an embodiment of the transfer device according to the invention.

FIG. 4 is a schematic side view showing an embodiment of the transfer device according to the invention. The transfer device comprises a transfer roller 51 including an electrically conductive shaft 52 and a resilient rubber roller 53 made of semiconductive material having a resistance of $10^6$ to $10^{10}\Omega$. The roller 53 is rotatably arranged in contact with or in proximity of a charge retentive member such as a photosensitive drum 54. The resistance value of the roller 53 was measured by placing the transfer roller 51 on a V-shaped metal block having a width of 100 mm and by applying a d.c. voltage of 100 volts between the block and the shaft 52. The shaft 52 of the transfer roller 51 is connected to a first transferring bias voltage source 56 by means of a current limiting resistor 55. Then a first transfer bias voltage $E_1$ is applied to the roller 53. One terminal of the voltage source 56 which is opposite to the polarity of charge on toners and thus, is same as the polarity of a latent image, is connected to the transfer roller 51 and the other terminal is connected to ground.

The current limiting resistor 55 should have a suitable value to take into account the following purpose. In the first place, the resistor 55 limits the flow of charge from the transfer roller 51 to the photosensitive drum 54. During the copying operation of forming a plurality of copies from the single latent image, charge should not be deposited on the photosensitive drum 54 from the transfer roller 51, otherwise the latent image might be deteriorated. That is to say, the resistor 55 can prevent the charge from being deposited on the drum 54 via the record paper 57. Further the resistor can also prevent a lot of charge from being deposited on the paper 57. If a lot of charge is deposited on the paper, there might be produced undesirous discharge between the paper and the photosensitive drum when the paper is peeled off the drum surface. Moreover, when a length and/or a width of the paper 57 are shorter than a circumferential length and/or a width of the drum 54, a part of the drum directly contacts the transfer roller 51 and the part (referred to as blind area) of the drum 54 receives a lot of charge from the roller 51. Then, the blind area is developed with toners during a next developing step and the toners are transferred onto the transfer roller 51. In this manner the transfer roller 51 might be disadvantageously stained with toners and some of the toners on the roller 51 might be transferred onto the rear surfaces of the papers.

During the copying operation of forming a plurality of copies from a single latent image, the toners retained on the blind area of the drum 54 might be charged with a polarity opposite to that of the original toners and thus, might attract much more toners. In this manner, at the end of the copying operation of a plurality of copies, a large amount of toners might adhere to the blind area of the photosensitive drum 54. Therefore, the cleaning operation might be increased and incomplete cleaning might appear. This results in a decrease in the image quality of duplicated copies. The resistor 55 can avoid the above mentioned various disadvantages.

Secondly, the resistor 55 can function to decrease automatically the value of the first transfer bias voltage, when the dampened papers 57 become less resistive and thus, the resistor can prevent the injection of charge from the transfer roller 51 into the drum 54 by means of the dampened papers, which show the low resistance due to high humidity of a surrounding atmosphere. In this manner, it is possible to prevent so-called fog from being formed in the latent image on the drum.

In order to attain the above mentioned purposes, the current limiting resistor 55 has advantageously a resistance value within a range of 100 MΩ to 1000 MΩ, preferably 300 MΩ to 700 MΩ.

In order to form a plurality of copies from the single latent image without fog while using plain papers having relatively high resistance under the normal humidity condition, it is preferable that the first transferring bias voltage $E_1$ be set to a value within a range of 600 to 900 V, preferably 700 to 800 V. If the bias voltage $E_1$ is made higher than the stated range, the fog might appear to a great extent, but if the voltage $E_1$ is made lower than the range, the transfer might not be effected sufficiently. At any rate, when the first transferring bias voltage $E_1$ is out of the range, it is impossible to form a plurality of copies having good image quality from the single latent image. It should be noted that in the single copy type machine, even if the above mentioned conditions are not satisfied, a copy of good quality can be obtained. In the known single copy type machine, usually the transferring bias voltage is made higher than said range. According to the invention, since the transferring bias voltage is set to a lower value than usual, it is advantageous to lower the potential of the latent image formed on the photosensitive drum 54 or to treat the surface of the drum so that the toners can easily leave the drum surface. As described above, the upper limit of the first bias voltage $E_1$ is determined by the production of fog and the lower limit is restricted by the decrease in the transferring efficiency.

In the present embodiment, a pair of auxiliary transfer rollers 58A and 58B, made of conductive material, are arranged on both sides of the transfer roller 51 in contact with the record paper 57. A second transferring bias voltage $E_2$ obtained by dividing the first transferring bias voltage $E_1$ by means of a potentiometer consisting of resistors 59 and 60 is applied to the auxiliary transfer rollers 58A and 58B.

Under the normal humidity of 30 to 70% RH, the record paper 57 shows a high resistance. Because of this, a resistance value of segments of the record paper between the roller 51 and the auxiliary rollers 58A and 58B is also very high. Therefore, the auxiliary transfer rollers 58A and 58B do not substantially influence the transferring operation. This can be confirmed experimentally by the fact that, even when a resistance $R_1$ of the resistor 59 in the potentiometer is made to zero ($R_1=0$) so as to apply the first transferring bias voltage $E_1$ to the auxiliary transfer rollers 58A and 58B, there does not occur any fog in the latent image during the retentive copying operation. Further, even when the connection to the auxiliary transfer rollers 58A and 58B is interrupted, there does not occur any variation in the image quality.

Under humidity conditions higher than 70% RH, the resistance of the record paper 57 is decreased to a great extent so that charge flows from the transfer roller 51 and the auxiliary transfer rollers 58A and 58B to ground through the record paper 57 and the photosensitive drum 54; and through the record paper and metal parts arranged along the paper feed path. However, since the paper segment between the auxiliary transfer rollers 58A and 58B is kept at the same potential, the second transferring bias voltage $E_2$ remains effective and the transferring operation can be effected satisfactorily. In this case the first transferring bias voltage $E_1$ applied to the transfer roller 51 is decreased to a very low value due to a voltage drop across the current limiting resistor 55 of high resistance and this reduced bias voltage does not appreciably influence the transferring operation.

When the resistance value of the resistor 55 is lowered, for example, to zero, the transferring efficiency is increased. In this case, the injection of charge from the transfer roller 51 as well as the auxiliary transfer rollers 58A, 58B into the photosensitive drum 54 through the record paper 57 becomes remarkable and an extremely large fog is formed during the duplication of a plurality copies from the single latent image. In order to avoid the fog it is certainly effective to decrease the transferring bias voltage $E_1$ so that copies of good quality can be obtained. However, in this case, the transferring efficiency under conditions of low humidity is greatly decreased. Therefore, it is not preferable to decrease the resistor 55 so as to make the transferring bias voltage $E_1$ lower for the highly dampened paper. Contrary to this, when the first bias voltage $E_1$ which is sufficiently high for dry papers is applied to the auxiliary transfer rollers 58A and 58B, a large amount of charge is injected into the drum 54 through the paper and it is impossible to avoid the fog during the retentive copying operation, because an amount of charge injected from the auxiliary rollers 58A, 58B is greater than that from the transfer roller 51 for the following reason. If the auxiliary transfer rollers 58A, 58B are made of a material having a resistance similar to or higher than that of the transfer roller 51, or an auxiliary high resistor is connected to the auxiliary transfer rollers in order to limit the injection of charge, then a large voltage drop will appear across the auxiliary rollers or the auxiliary resistor so that the transferring efficiency might be decreased. Therefor, it is preferable that the auxiliary transfer rollers are made of less resistive material or the auxiliary resistor has a lower resistance. Then, if the second bias voltage $E_2$, which is substantially equal to the first bias voltage $E_1$, is applied to the auxiliary rollers, the fog might appear under the conditions of high humidity. Therefore, it is preferable that the second bias voltage $E_2$ is made lower than the first bias voltage $E_1$.

Figure 5:
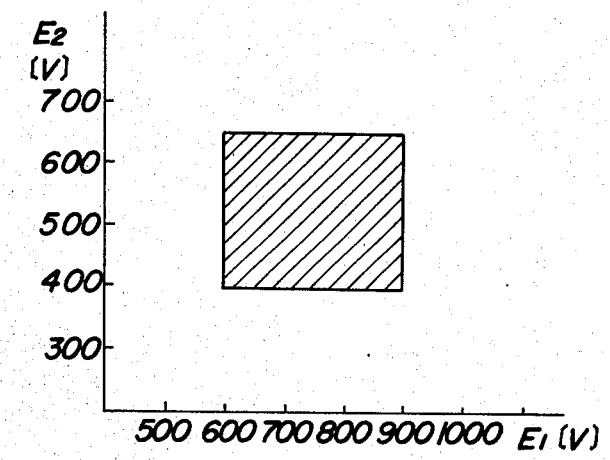
FIG. 5 is a graph representing a preferable range of the first and second transferring vias voltages according to the invention.

FIG. 5 is a graph showing a preferable range of the first and second bias voltages $E_1$ and $E_2$, which range has been determined experimentally. A hatched area denotes the preferable range. The second bias voltage $E_2$ is preferably set to a value within a range of 400 to 650 V, and the first bias voltage $E_1$ is preferably determined to a value within a range of 600 to 900 V in accordance with the resistance value of $10^6$ to $10^{10}\Omega$ of the semiconductive material forming the roller 53. When the resistance of the roller 53 is higher, the first bias voltage $E_1$ is preferably made higher.

Figure 6:
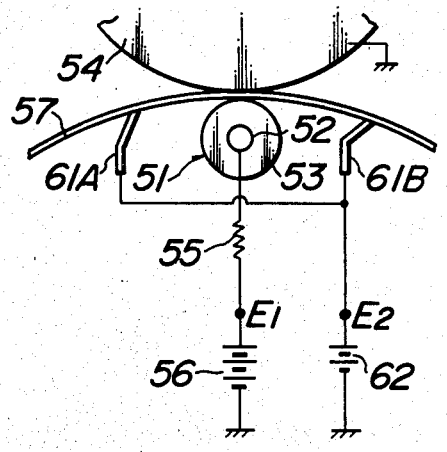
FIG. 6 is a schematic view showing another embodiment of the transfer device according to the invention.

FIG. 6 is a schematic view showing another embodiment of the transfer device according to the invention. In this embodiment use is made of a pair of conductive plates 61A and 61B arranged on both sides of the transfer roller 51 as the auxiliary transferring member. To these plates is applied a second transferring bias voltage $E_2$ from a separate voltage source 62. The remaining construction is the same as that of the previous embodiment.

The present invention is not limited to the embodiments explained above, but many modifications may be conceived within the scope of the invention. For instance, in the above embodiments, a pair of the auxiliary rollers and plates are provided on both sides of the transfer roller, but only one auxiliary transferring member may be arranged on either side of the transfer roller.

As explained above, according to the invention, the first bias voltage $E_1$ is applied to the transfer roller through the current limiting resistor of high resistance value and the auxiliary transferring member is arranged near the transfer roller. The second bias voltage, which is lower than said first bias voltage, is applied to the auxiliary transfer member. Then, under the low humidity condition, the transfer roller can generate the required transferring electric field and under the high humidity condition, the first bias voltage is decreased by the voltage drop across the high resistor and now the second bias voltage becomes effective to generate the effective transferring electric field. In this manner the effective transferring bias voltage is automatically controlled in accordance with the change of resistance of the record papers due to the humidity. Thus, the injection of charge into the charge retentive member through the record paper always can be limited. Therefore, a plurality of copies of excellent image quality without fog always can be obtained from the single latent image under any humidity condition.

What is claimed is:

1. A transfer device for use in a retention type electrophotographic copying machine in which a plurality of copies are formed from the same and single electrostatic charge image once formed on a charge retentive member by subjecting repeatedly the charge image to developing and transferring steps, said transfer device comprising:

a transfer member having a conductive shaft and a roller which is arranged around said shaft and is made of semiconductive material, said roller being arranged in the vicinity of said charge retentive member;

a resistor connected in series with said conductive shaft;

first transfer bias voltage source means for applying a first transfer bias voltage to said roller through said resistor;

an auxiliary transfer member arranged in the neighborhood of said transfer means and being in contact with a record paper; and second transfer bias voltage source means for applying a second transfer bias voltage to said auxiliary transfer member; said first and second transfer bias voltages being set to such values that, when said record paper is in a higher resistance condition, the first transfer bias voltage becomes operative to produce a transferring electric field, and, when said record paper is in a lower resistance condition, said second transfer bias voltage becomes effective to generate the transferring electric field, so that an injection of charge into a background area of the charge image on the charge retentive member is prevented.

2. A transfer device according to claim 1, wherein said first transferring bias voltage is made higher than said second transferring bias voltage.

3. A transfer device according to claim 2, wherein said first transferring bias voltage is set to a value within a range of 600 to 900 volts and said second transferring bias voltage is set to a value within a range of 400 to 650 volts.

4. A transfer device according to claim 2, wherein said second transferring bias voltage source means is constructed by a potentiometer connected to said first transferring bias voltage source means.

5. A transfer device according to claim 1, wherein said first and second transferring bias voltage source means are each separate voltage sources.

6. A transfer device according to claim 1, wherein said resistor has a resistance value within a range of about 100 MΩ to about 1000 MΩ.

7. A transfer device according to any one of claims 1 to 6, wherein said auxiliary transfer member is formed by a pair of auxiliary transfer rollers made of conductive material arranged on respective sides of said transfer member.

8. A transfer device according to any one of claims 1 to 6, wherein said auxiliary transfer member is formed by a pair of conductive plates arranged on respective sides of the transfer member.

9. A transfer device according to claim 6, wherein said resistor has a resistance value within a range of about 300 MΩ to about 700 MΩ.

* * * * *